US009061865B2

(12) United States Patent
Osmanbasic

(10) Patent No.: US 9,061,865 B2
(45) Date of Patent: Jun. 23, 2015

(54) ELEVATOR CAGE DEPARTURE MONITORING DEVICE AND METHOD

(75) Inventor: Faruk Osmanbasic, Cham (CH)

(73) Assignee: Inventio AG, Hergiswil (CH)

( * ) Notice: Subject to any disclaimer, the term of this patent is extended or adjusted under 35 U.S.C. 154(b) by 827 days.

(21) Appl. No.: 13/327,133

(22) Filed: Dec. 15, 2011

(65) Prior Publication Data

US 2012/0152658 A1 Jun. 21, 2012

(30) Foreign Application Priority Data

Dec. 17, 2010 (EP) ..... 10195788

(51) Int. Cl.
*B66B 1/34* (2006.01)
*B66B 5/04* (2006.01)

(52) U.S. Cl.
CPC .. *B66B 5/04* (2013.01); *B66B 5/044* (2013.01)

(58) Field of Classification Search
CPC ..... B66B 5/04; B66B 5/044
USPC ..... 187/277, 284, 286, 287, 288, 289, 290, 187/291, 305, 391–393
See application file for complete search history.

(56) References Cited

U.S. PATENT DOCUMENTS 5,002,158 A 3/1991 Ericson et al.
6,651,781 B2 * 11/2003 Lindegger et al. ..... 187/394
7,014,014 B2 * 3/2006 Mueller ..... 187/305
7,353,916 B2 * 4/2008 Angst ..... 187/393
7,588,127 B2 * 9/2009 Shiratsuki et al. ..... 187/391
7,617,911 B2 * 11/2009 Mattila et al. ..... 187/391
7,775,330 B2 * 8/2010 Kattainen et al. ..... 187/393
7,950,499 B2 * 5/2011 Okamoto et al. ..... 187/394
8,365,873 B2 * 2/2013 Viita-Aho et al. ..... 187/393
8,464,841 B2 * 6/2013 Birrer et al. ..... 187/393
8,857,572 B2 * 10/2014 Leutenegger et al. ..... 187/394
2010/0187046 A1 * 7/2010 Stolt et al. ..... 187/293

FOREIGN PATENT DOCUMENTS

EP 1980519 A1 10/2008
GB 2179795 A 3/1987
WO 2005066058 A2 7/2005
WO 2009050326 A1 4/2009
WO 2010019124 A1 2/2010

* cited by examiner

*Primary Examiner* — Anthony Salata
(74) *Attorney, Agent, or Firm* — Fraser Clemens Martin & Miller LLC; William J. Clemens

(57) ABSTRACT

An electromechanical monitoring device for detecting undesired departure of an elevator cage from standstill includes a co-running wheel which when required is pressed against a guide track of the elevator cage, possibly against a running diameter of the speed limiter. A sensor detects rotation of the co-running wheel and actuates a braking device if a rotational angle of the co-running wheel exceeds a predetermined value. This electromechanical monitoring device can be suitable for attachment to or installation in a speed limiter and can be suitable for retrofitting to elevator installations.

17 Claims, 5 Drawing Sheets

ELEVATOR CAGE DEPARTURE MONITORING DEVICE AND METHOD

CROSS-REFERENCE TO RELATED APPLICATION

This application claims priority to European Patent Application No. 10195788.4, filed Dec. 17, 2010, which is incorporated herein by reference.

FIELD

The disclosure relates to detecting departure of an elevator cage from standstill.

BACKGROUND

An elevator installation is installed in a building. It substantially comprises an elevator cage which is connected by way of support means with a counterweight or with a second elevator cage. By means of a drive, which selectably acts on the support means or directly on the elevator cage or the counterweight, the elevator cage is moved along substantially vertical guide rails. The elevator installation is used for transporting persons and goods within the building over single or multiple stories. The elevator installation includes devices in order to help ensure safety of the elevator installation. A device of that kind protects, for example in the case of stopping at a story of the building, the elevator cage from unintended drifting away. For that purpose use is made of, for example, braking devices which, when required, can brake the elevator cage.

A device of that kind is known from WO 2005/066058. The device consists of a clamping device which in the case of standstill of the elevator cage clamps a moved part, a movement sensor system which detects movement of the clamping device and a control device which evaluates the movement and actuates a safety device if required.

SUMMARY

At least some of the disclosed embodiments provide an alternative monitoring device for detecting unintended departure of an elevator cage from standstill, which can be simple to install and which can also be suitable for retrofitting in an elevator installation if required.

According to one variant of embodiment of an electromechanical monitoring device for detecting unintended departure of an elevator cage from standstill the electromechanical monitoring device includes a co-running wheel which when required is pressed against a guide track of the elevator cage. A requirement of that kind is, for example, a stop at a story. This can be detected in that a drive of the elevator installation stops, and an associated first braking device or a drive brake is actuated or an access door to the cage is opened. During normal travel of an elevator cage the electromechanical monitoring device is in a normal setting, i.e. the co-running wheel is spaced from the guide track and thus does not contact the guide track. If required, the electromechanical monitoring device is brought into a readiness setting, i.e. the co-running wheel is pressed against the guide track, whereby in the case of movement of the elevator cage it is rotated in correspondence with a movement direction.

The monitoring device further includes a sensor which detects rotation of the co-running wheel through a predetermined rotational angle. If the sensor detects exceeding of the predetermined rotational angle, a braking device, possibly a second braking device, is actuated or it initiates another action which fixes or brakes the elevator cage. The electromechanical monitoring device is then in its trigger setting. The second braking device can, for example, be a cage brake or a safety brake device, which is arranged directly on the elevator cage and which is in a position of fixing the elevator cage in co-operation with a wall of the elevator shaft or a guide rail of the elevator cage, etc.

The use of the co-running wheel, which if required is pressed against the guide track of the elevator cage, can be advantageous, since coming into question as the guide track is any track or surface which runs continuously over the travel path of the elevator cage or represents the travel path of the elevator cage. The co-running wheel can be of simple design and can be correspondingly advantageous to procure.

A rotational angle transmitter can be used as sensor, wherein a rotational angle of the co-running wheel is detected. In this regard, the braking device is triggered in the case of exceeding of a preset rotational angle. If required, two or more rotational angles can also be preset. In that case, in the case of exceeding of a first rotational angle at the co-running wheel the braking device is actuated and in the case of exceeding of a further value, for example, a prong could be moved out which firmly engages in the region of the elevator door or of rail fastenings, etc.

An elevator installation equipped with a monitoring system of that kind can be particularly reliable and advantageous with respect to safeguarding against drifting of the elevator cage away from a stopping point and can be suitable for being installed or retrofitted in an existing elevator installation. If needed, an existing braking device can in that case be activated. Insofar as an appropriately activatable braking device is not present in the elevator, an electromechanical actuation such as known from, for example, EP 0543154 can, however, be incorporated in an existing braking device or obviously also a new, remotely actuable brake can be installed.

A corresponding retrofitting device of the monitoring system possibly includes a support which contains the required mounting positions for movable parts such as a rocker for mounting the co-running wheel, etc. A retrofitting device of that kind can be employed at and fastened to a guide track of the elevator cage in simple manner. Further mechanical adaptations are not necessarily required, since entrainment of the co-running wheel takes place solely by friction couple through pressing of the wheel against the guide track. Moreover, the retrofitting device possibly also includes a corresponding electronics box which contains the required circuits for activation of the monitoring device as well as energy supply units with store.

In another embodiment or development the co-running wheel drives a cam disc. The cam disc can in that case be directly combined with the co-running wheel. The sensor, which in this embodiment can be an electromechanical switch, is now actuated in simple manner by a cam of the cam disc on rotation of the co-running wheel or of the associated cam disc. This can be an economic construction, since there is no need for an expensive electronic evaluating system. As soon as the co-running wheel is pressed against the guide track of the elevator cage and a movement of the elevator cage takes place the co-running wheel together with the cam is rotated. As soon as the cam reaches the electromechanical switch this is switched and a braking device controlled by this switch is actuated.

In another embodiment or development the co-running wheel, if need be together with the cam disc, is automatically moved into a neutral setting or zero position as soon as the co-running wheel is spaced from the guide track. This can take place, for example, by way of a spring device or, possibly, the co-running wheel or the cam disc connected therewith is so constructed that a gravitational center of mass constrainedly rotates the cam disc or the cam back into the neutral setting or zero position. It can be advantageous in this connection if the preset rotational angle corresponds with half a revolution of the co-running wheel. A single electromechanical switch can thus recognize drifting away of the elevator cage in both directions of travel. This embodiment can enable an economic and reliable monitoring device, since, in particular, the function thereof can also be simple to see and understand.

In another embodiment or development the electromechanical switch is a commercially available detenting or bistable switch. This means that the switch after actuation remains in the switched position until it is reset back to the normal or working position either manually or by an appropriate remote resetting device. Possibly, this switch is so constructed that a power circuit for activation of the braking device is closed in the normal or working position and is correspondingly interrupted in the actuated or switched position. A level of safety can thereby be achieved, since interruption in the activation always leads to braking.

In another embodiment or development the co-running wheel is pressed against the guide track of the elevator cage by means of a pressing spring and is kept at a spacing from the guide track by means of an electromagnet. Possibly, the electromagnet is designed in such a manner that it can draw away the co-running wheel against a spring force of the pressing spring. Thus, in the case of energy failure the monitoring device is automatically moved into the readiness setting or slipping of the elevator cage is monitored and at the same time by virtue of the pressing spring different forms of an attachment can be realized. Moreover, this monitoring system is insensitive to vibrations.

The drive control of the electromagnet can be equipped with an energy store, for example a battery, in order in the case of power failure in the building to keep the co-running wheel at a spacing from the guide track at least during running-on of the elevator cage until standstill.

Alternatively or additionally the co-running wheel is pressed by means of weight mass against the guide track of the elevator cage and it is kept at a spacing from the guide track by means of an electromagnet. Possibly, in that case the electromagnet is designed in such a manner that it can draw the co-running wheel away from the guide track against a weight mass. This can provide an economic and reliable construction, since the weight force is available on a worldwide basis. This system also otherwise corresponds with the embodiment such as explained in conjunction with the pressing spring, wherein in the case of installation in an elevator installation the installed position has to take into consideration the course of the weight force.

If required, the co-running wheel or the guide track against which the co-running wheel is pressed can be structured, corrugated, roughened or milled so as to help ensure reliable driving of the co-running wheel. It can also be made from or coated with a material with a high coefficient of friction such as, for example, polyurethane.

In another embodiment or development the guide track of the elevator cage corresponds with a circumference of a speed limiter and the speed limiter is connected or connectible with a limiter cable for the elevator cage. This cable rotates the speed limiter in correspondence with a movement of the elevator cage, whereby the movement of the circumference of the speed limiter directly represents the guide track of the elevator cage. The electromechanical monitoring device is accordingly arranged at the speed limiter or directly installed at the speed limiter, wherein the co-running wheel is if required pressed against the circumference of the speed limiter.

In this embodiment the monitoring device can be installed in or attached to an existing elevator installation in particularly simple manner, since the equipment can be mounted in stationary position in the building and associated electrical wiring can be led to an elevator control. In addition, a substitute speed limiter can now be directly provided for an existing elevator installation. Thus, for the purpose of retrofitting an elevator installation an existing speed limiter without a monitoring device can be simply be exchanged for the new speed limiter with a monitoring device.

Combinations of the illustrated embodiments enable individual solutions appropriate to requirement. The monitoring device can also be installed at any other disc which is connected with the elevator cage and rotates in correspondence with movement of the elevator cage. Such a disc can be, for example, a drive pulley, a deflecting or diverting roller, a support roller or also a guide roller.

BRIEF DESCRIPTION OF THE DRAWINGS

The disclosed technologies are explained using exemplary embodiments and using the figures, in which.

The same reference numerals are used in the figures for equivalent parts over all figures.

DETAILED DESCRIPTION

Figure 1:
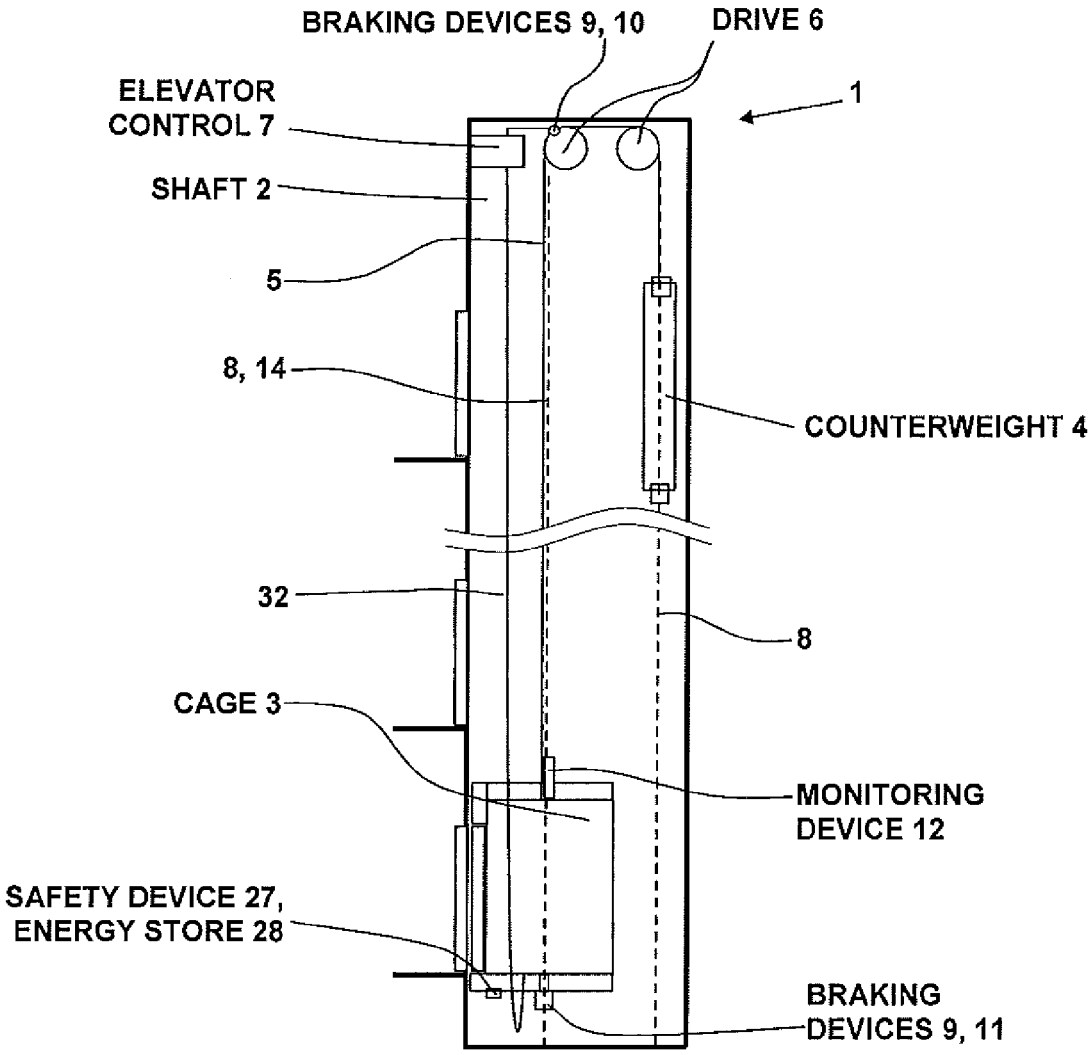
FIG. 1 shows a schematic view of an elevator installation in side view, with a monitoring device attached to the elevator cage.

FIG. 1 shows an elevator installation in overall view. The elevator installation 1 is installed in a building, possibly in an elevator shaft 2. It substantially consists of an elevator cage 3, which is connected by way of support means 5 with a counterweight 4 or alternatively also with a second elevator cage (not illustrated). The cage 3 and correspondingly also the counterweight 4 are moved along substantially vertical guide rails 8 by means of a drive 6 which possibly acts on the support means 5. The elevator installation 1 is used for transporting persons and goods within the building over individual or several stories.

The drive 6 is connected with an elevator control 7 which controls and regulates the drive 7 and thus the elevator installation 1. The elevator control 7 is, in the example, also connected by way of a suspension cable 32 with the elevator cage 3 in order to exchange requisite signals.

The elevator installation 1 includes braking devices 9 in order to fix the elevator cage when required and to ensure safety of the elevator installation. In the example a first braking device 10 is arranged in the region of the drive 6. This first braking device 10, for example, fixes the elevator installation or the elevator cage 3 in the case of a stop at a story. This first braking device 10 is usually a component of the drive 6 and is activated by the elevator control 7. This first braking device 10 can also be arranged separately from the drive 6, for example on the elevator cage or the counterweight or at a deflecting roller. The elevator installation 1 includes a further, second braking device 11 which is arranged directly on the elevator cage 3 and which can act directly on the guide rail 8 for the purpose of braking the elevator cage 3. This second braking device 11 is, in the example, a safety brake device which is activated by means of an electronic limiter by way of a safety device 27.

The elevator installation 1 further includes an electromechanical monitoring device 12 which is arranged at the elevator cage 3 and which in co-operation with a guide track 14 defined by the guide rails 8 of the elevator cage 3 can detect an unanticipated slipping away or drifting away of the elevator cage 3 and can actuate the second braking device 11 by way of the safety device 27. Energy stores 28 which may be required can be arranged in the safety device. This energy store can ensure, in the case of failure of the energy mains, at least functioning of the electromechanical monitoring device 12 until the elevator installation is at standstill. Details of the electromechanical monitoring device 12, such as is used in the elevator installation according to FIG. 1, are explained in FIGS. 3 to 5.

Figure 2:
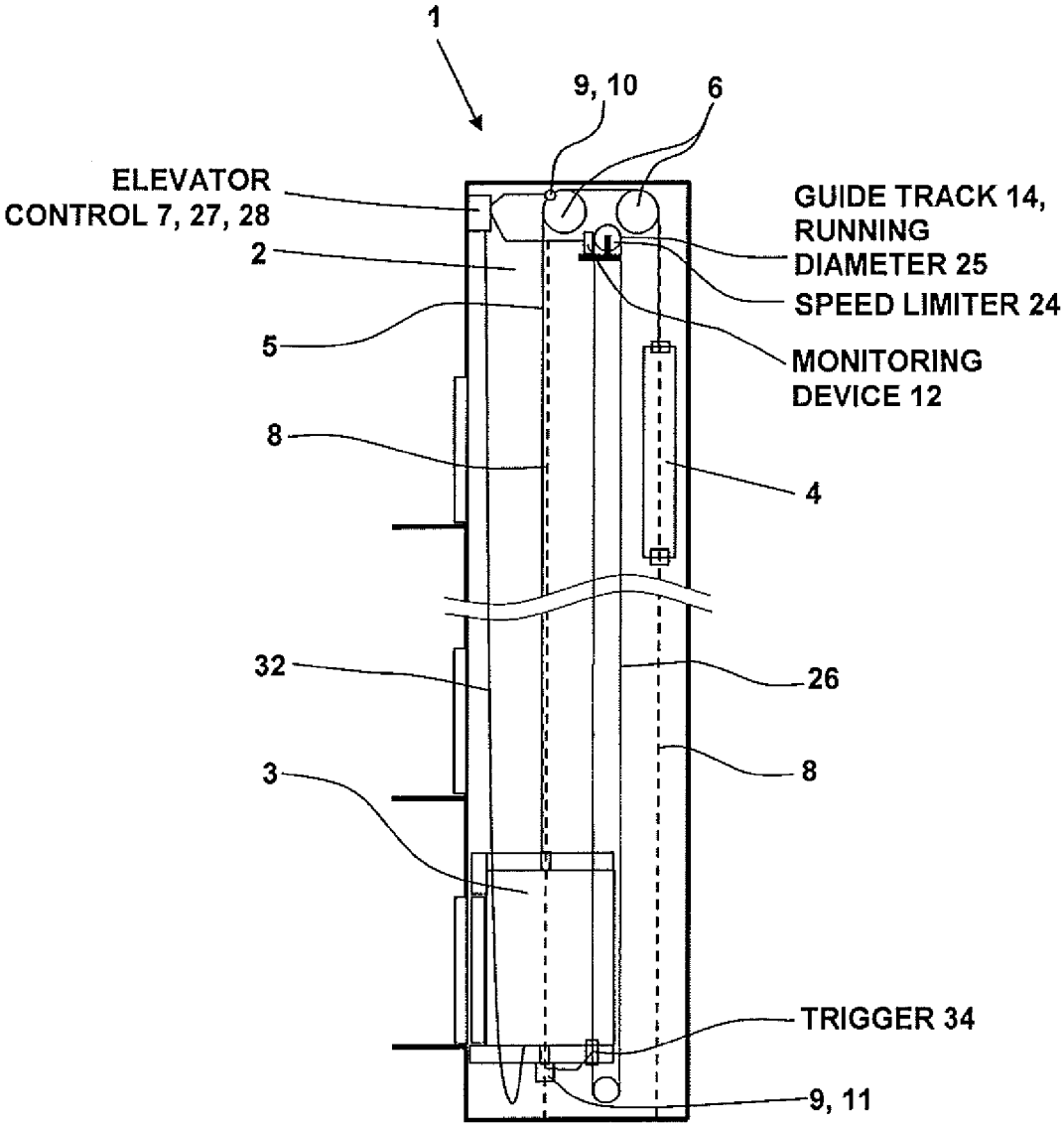
FIG. 2 shows a schematic view of an elevator installation in side view, with a monitoring device attached to a speed limiter.

FIG. 2 shows another embodiment of an electromechanical monitoring device 12 in an elevator installation. The elevator installation in basic concept is constructed as explained in FIG. 1. However, this elevator installation 1 includes a second braking device 11 which can essentially be a known conventional safety brake device. This safety brake device is, when required, actuated by a speed limiter 24. The speed limiter 24 is connected with the safety brake device by way of a limiter cable 26. The limiter cable 26 is thus moved by the elevator cage 3, at which the safety brake device is arranged, in company therewith and the speed limiter 24 is correspondingly moved by the limiter cable 26. As soon as the speed limiter 24 detects an excessive speed, the speed limiter 24 blocks the limiter cable 26 and the now braked limiter cable 26 actuates—usually by way of an appropriate lever mechanism (not illustrated)—the safety brake device or the second braking device 11.

In the embodiment according to FIG. 2 the electromechanical monitoring device 12 is arranged at this speed limiter 24. In co-operation with a guide track 14, which is defined by a circumference of the speed limiter 24, the electromechanical monitoring device 12 can detect an unanticipated slipping or drifting away of the elevator cage 3 and it can actuate the second braking device 11 by way of an auxiliary triggering means 34. In the example, the auxiliary triggering means is controlled by way of the elevator control 7 and the suspension cable 32 by the electromechanical monitoring device 12. The auxiliary triggering means 34 is, for example, a clamp which when required engages the guide rail 8 and actuates the safety brake device. An auxiliary coupling of that kind is known from, for example, the publication EP 0543154. Alternatively, a second brake 11 which is additional to the safety brake device can also be mounted on the elevator cage and then is actuated, for example, by the electromechanical monitoring device 12 merely to prevent drifting away. Details of the electromechanical monitoring device 12 such as is now used in the elevator installation according to FIG. 2 are explained in FIGS. 6 and 7 in conjunction with FIGS. 3 to 5.

Figure 3:
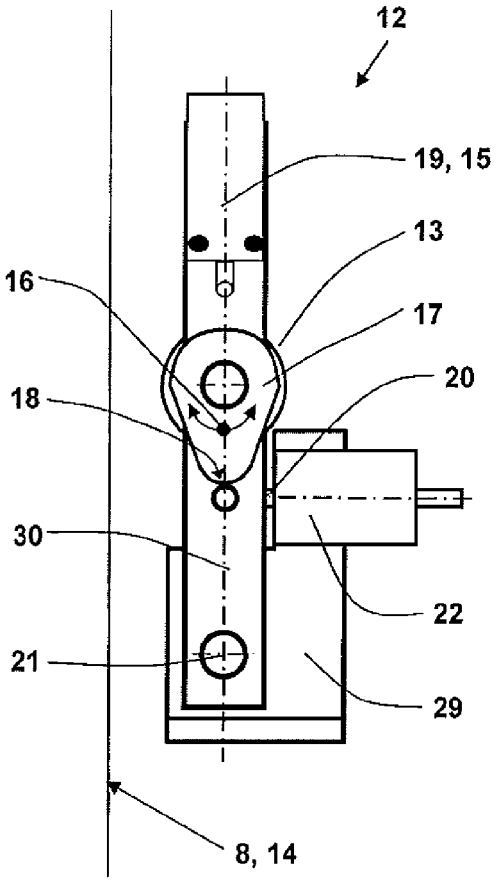
FIG. 3 shows an electromechanical device in normal setting.
Figure 4:
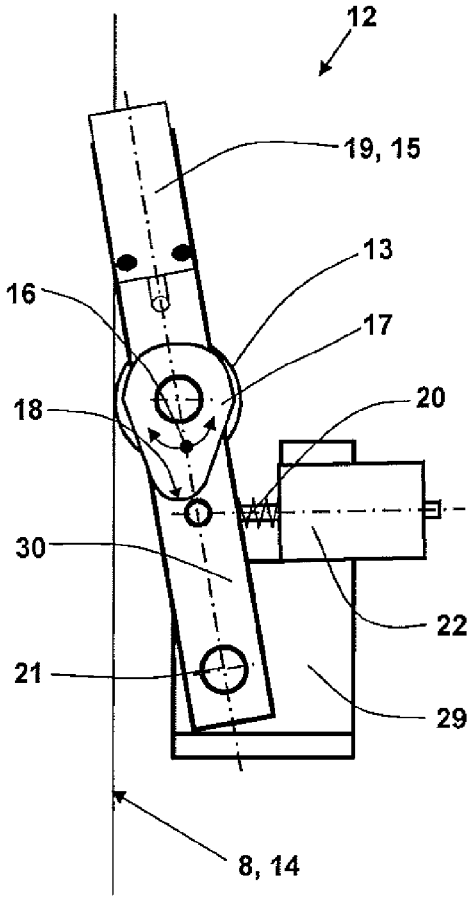
FIG. 4 shows the electromechanical monitoring device of FIG. 3 in readiness setting.
Figure 5:
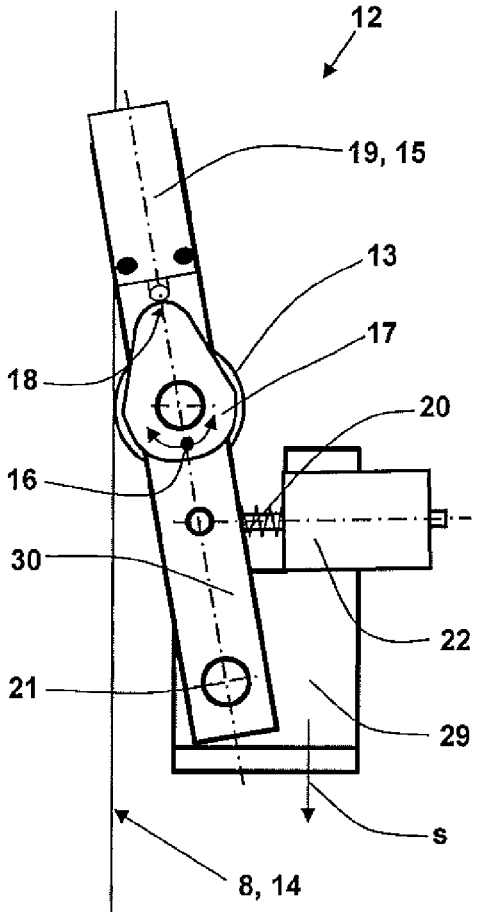
FIG. 5 shows the electromechanical monitoring device of FIG. 3 in trigger setting.

A construction and the function of an electromechanical monitoring device 12 such as can be used in the elevator installation according to FIG. 1 or analogously also in FIG. 2 are explained in FIGS. 3 to 5. The electromechanical monitoring device 12 includes a support 29 which can be fastened to a part of the elevator installation, for example to the elevator cage, the speed limiter or a frame of the drive. A rocker 30 is mounted on the support 29 to be pivotable about a pivot axis 21. A co-running wheel 13 is rotatably mounted in the rocker 30 and a cam disc 17 with a cam 18 co-runs on the rotational axle of the co-running wheel 13.

The weight component of the cam 18 in that case rotates, due to the weight force, the cam disc 17 in the normal position as long as no external forces are present. The rocker 30 is moved by means of an electromagnet 22 between a normal setting as illustrated in FIG. 3 and a readiness setting as illustrated in FIG. 4. In the example, a spring 20 urges the rocker 30 together with the co-running wheel 13 into the readiness setting (see FIG. 4) and the electromagnet 22 draws the rocker 30 back into the normal setting against the spring force of the spring 20.

The electromechanical monitoring device 12 or the support 29 is so arranged with respect to the guide track 14 that in the normal setting the co-running wheel 13 is at a spacing from the guide track 14, thus free of contact. In the readiness setting the co-running wheel 13 is pressed against the guide track 14. Activation of the electromagnet 22 is carried out, for example, by way of the safety device 27 or directly by way of the elevator control 7. Thus, for example, as soon as a door of the elevator cage 3 is opened by a certain amount the electromagnet 22 is switched by way of a corresponding switch to be free of current and the co-running wheel 13 is pressed against the guide track 14 or the electromagnet is switched to be free of current as soon as the first braking device 10 receives a command for closing.

In one embodiment the safety device 27 for activation of the electromechanical monitoring device 12 is so constructed that it takes into consideration a combination of the signals of the first braking device 10 and the closed or opened state of the door of the elevator cage 3. Alternatively, instead of or in addition to the closed or opened state of the door of the elevator cage 3 use can also be made of story information, for example a story switch which is switched when the elevator cage 3 is located in the region of a story or a floor. This can be useful, for example, in old elevator installations where in part use is still made of elevator cages without a cage door. The response behavior of the electromechanical monitoring device 12 can thus be matched to specific characteristics of the elevator installation.

If the elevator cage 3 now remains correctly at standstill, the co-running wheel 13 with the cam 18 remains in the readiness setting illustrated in FIG. 4.

If, however, the elevator cage 3 unintentionally moves out of standstill as illustrated in FIG. 5 by the movement arrow s, the cam disc 17 together with the cam 18 is rotated through a rotational angle 16. The setting of this rotation or the rotational angle 16 is detected by a sensor 15, constructed as an electromechanical switch 19 in the example. If the switch 15 is now actuated by the cam 19, the electromechanical monitoring device 12 is disposed in the trigger setting and the second braking device is thereby actuated (see FIG. 1 or FIG. 2).

As long as the switch 19 is not actuated, the electromagnet 22 can draw the rocker 30 back again at any time and the cam 18, by virtue of its weight, again returns to the normal position. However, as soon as the switch 19 is actuated the intervention of an informed person is usually required in order to reset the device. In this embodiment a response sensitivity of the device is determined by way of the geometry of the co-running wheel. For example, a diameter of the co-running wheel is so selected that a response delay in correspondence with a travel deviation s of approximately 30 to 100 mm (millimeters) arises. In an exemplifying embodiment a diameter of the co-running wheel is approximately 50 mm. A travel deviation s of approximately 75 mm is thus recognized. Typical small movements of the elevator cage at standstill can thus be picked up. These small movements arise, for example, due to stretchings of the support means during loading and unloading processes.

Figure 6:
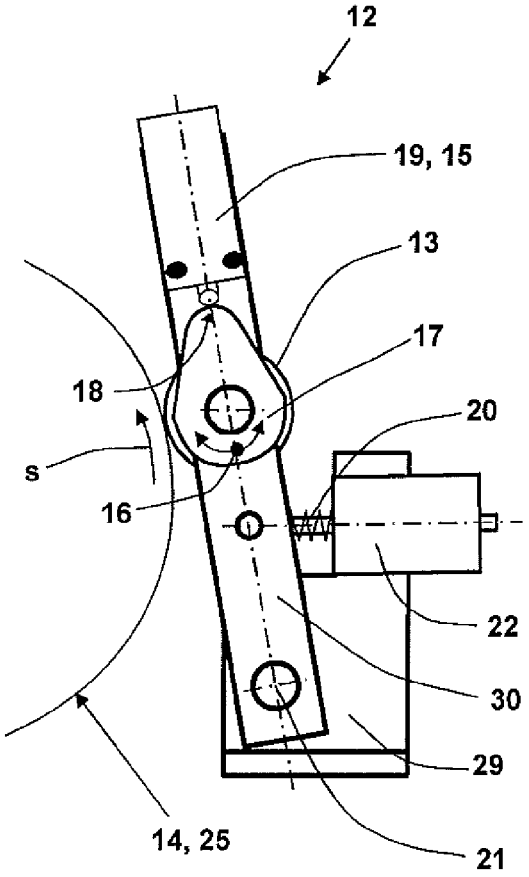
FIG. 6 shows the electromechanical monitoring device of FIG. 3 in conjunction with a guide track of a speed limiter and FIG. 7 shows an electromechanical monitoring device attached to a speed limiter.

The same electromechanical monitoring device 12 as explained with reference to FIGS. 3 to 5 can also be arranged at a curved guide track 14. This is illustrated in FIG. 6, by way of the trigger setting, analogously to FIG. 5. The electromagnet 22 has freed the rocker 30 and the spring 20 presses the co-running wheel 13 against the guide track 14. In the example, this guide track 14 is a running diameter 25 of the speed limiter 24. The guide track 14 can alternatively also be defined by a deflecting roller or a guide roller.

Figure 7:
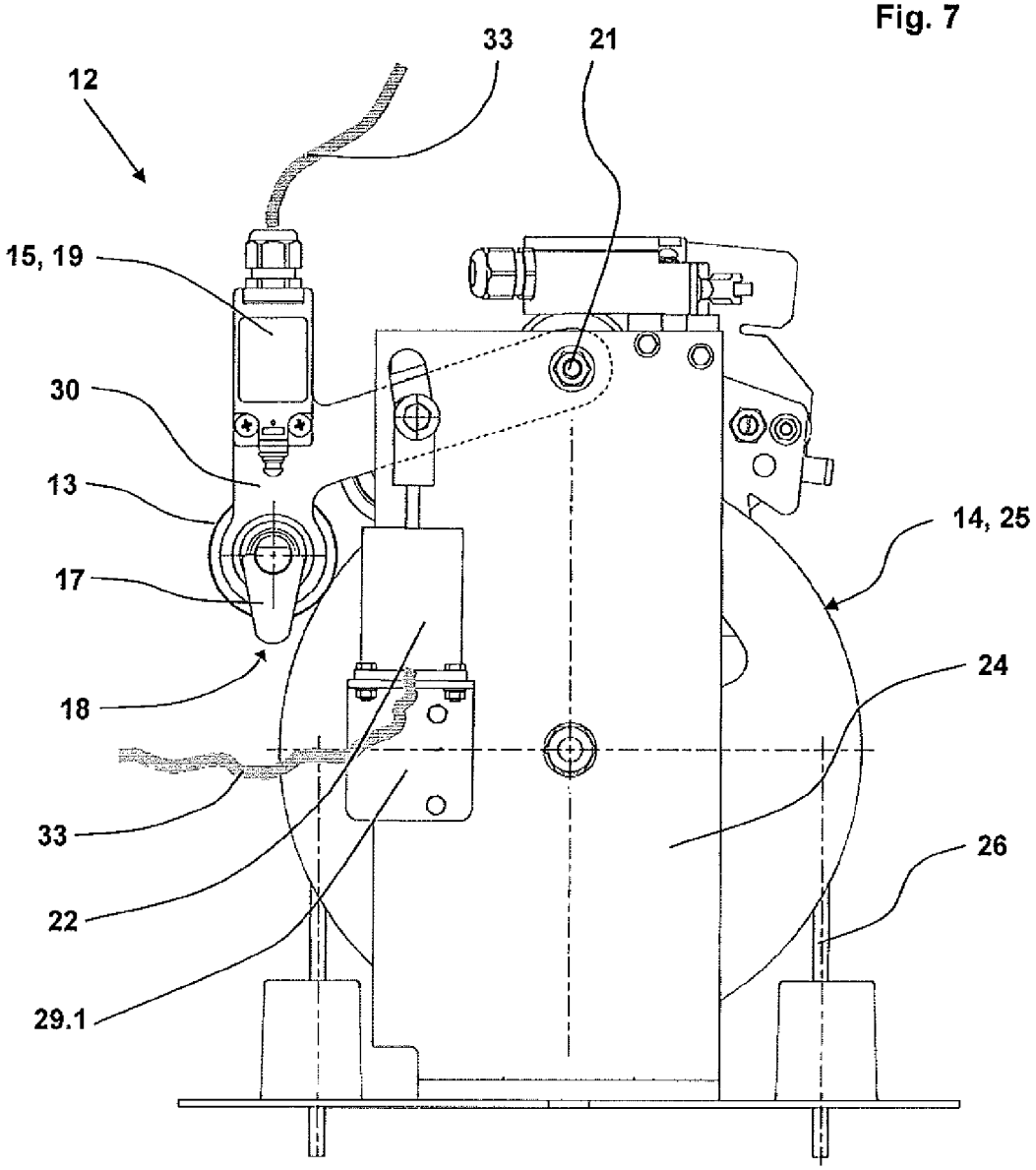

In FIG. 7 the electromechanical monitoring device 12 is installed in a speed limiter 24. The illustration shows the electromechanical monitoring device 12 in the readiness setting in correspondence with FIG. 4. The speed limiter 24 is driven by means of a limiter cable 26 and connected with the elevator cage. The rocker 30 is arranged at the speed limiter 24 to be pivotable about the pivot axis 21. The co-running wheel 13 together with the cam disc 17 and the cam 18 is rotatably mounted on the rocker 30. The electromagnet 22, which in the example according to FIG. 7 is fastened to the speed limiter 24 by way of an auxiliary bracket 29.1, is in the illustrated readiness setting switched to be free of current and the intrinsic weight of the rocker 30 urges the co-running wheel 13 against a running diameter 25 of the speed limiter 24. The running diameter 25 thus forms the guide track 14 for the electromechanical monitoring device 12.

If the elevator cage was now moved away from standstill, the co-running wheel 13 would rotate the cam 18 and after approximately half a revolution of the co-running wheel 13 the cam 18 would actuate the safety switch 19 or the sensor 15, whereby, as already explained several times, a braking device would be brought into action.

On the other hand, in the example according to FIG. 7, the electromagnet 22 in switched-on state can urge the rocker 30 together with the co-running wheel 13 away from the running diameter 25, whereby the electromechanical monitoring device 12 can be brought into its normal setting.

The electrical parts of the electromechanical monitoring device 12 are connectible with the elevator control 7 or the safety device 27 by way of an electrical connecting cable 33.

With knowledge of the present disclosure one can change the set shapes and arrangements as desired. For example, the cam disc 17 can be formed with a plurality of cams or several sensors 15 or switches 19 can be arranged over the rotational angle 16 of the cam disc. One can design constructional shapes and select feasible materials. Thus, one can load subregions of the rocker so as to obtain sufficient pressing forces.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator cage monitoring device, comprising:

a co-running wheel, the co-running wheel being configured to be pressed against a guide track of an elevator cage in a readiness setting and to be spaced from the guide track of the elevator cage in a normal setting; and a sensor, the sensor being configured to detect a rotation of the co-running wheel and being further configured to actuate a braking device upon determining that a predetermined rotational angle is exceeded by the rotation.

2. The elevator cage monitoring device of claim 1, the co-running wheel being configured to drive a cam disc, the sensor comprising an electromechanical switch, the electromechanical switch being actuatable by a cam of the cam disc upon rotation of the cam disc, the electromechanical switch being configured to actuate the braking device.

3. The elevator cage monitoring device of claim 2, the cam being a single cam, the single cam forming a mass component that moves the cam disc and the co-running wheel into a neutral setting or a zero position when the co-running wheel is spaced from the guide track.

4. The elevator cage monitoring device of claim 2, the electromechanical switch comprising a detenting switch or bistable switch, the electromechanical switch being resettable after actuation by the cam of the cam disc.

5. The elevator cage monitoring device of claim 1, further comprising:

a spring, the spring being configured to press the co-running wheel against the guide track; and an electromagnet, the electromagnet being configured to hold the co-running wheel away from the guide track against a force of the spring.

6. The elevator cage monitoring device of claim 1, further comprising:

a weight mass, the weight mass being configured to press the co-running wheel against the guide track; and an electromagnet, the electromagnet being configured to draw the co-running wheel away from the guide track against a force of the weight mass.

7. The elevator cage monitoring device of claim 1, the co-running wheel being configured to be in a neutral setting or a zero position when the co-running wheel is spaced from the guide track.

8. The elevator cage monitoring device of claim 1, further comprising:

a support with an electromagnet;

a rocker, the co-running wheel being arranged on the rocker; and a mounting point for the rocker.

9. A speed limiter, comprising:

an elevator cage monitoring device, the elevator cage monitoring device comprising a co-running wheel and a sensor, the co-running wheel being configured to be pressed against a guide track of an elevator cage in a readiness setting and to be spaced from the guide track of the elevator cage in a normal setting, and the sensor being configured to detect a rotation of the co-running wheel and being further configured to actuate a braking device upon determining that a predetermined rotational angle is exceeded by the rotation, the speed limiter being connectible with the elevator cage by a limiter cable.

10. An elevator installation, comprising:

an elevator cage disposed in an elevator shaft;

a first braking device, the first braking device being configured to keep the elevator cage at standstill;

a second braking device, the second braking device being electrically actuable and being configured to brake and hold the elevator cage; and an electromechanical monitoring device, comprising, a co-running wheel, the co-running wheel being configured to be pressed against a guide track of the elevator cage in a readiness setting when the first braking device is actuated and to be spaced from the guide track of the elevator cage in a normal setting, and a sensor, the sensor being configured to detect a rotation of the co-running wheel and being further configured to actuate the second braking device upon determining that a predetermined rotational angle is exceeded by the rotation.

11. The elevator installation of claim 10, the elevator cage being coupled to a speed limiter by a limiter cable, the electromechanical monitoring device being installed at or on the speed limiter, the guide track of the elevator cage being a running diameter of the speed limiter.

12. The elevator installation of claim 10, the sensor being connected with an electronic safety device, the sensor being configured to activate the second braking device through the electronic safety device.

13. The elevator installation of claim 10, the electromechanical monitoring device further comprising an energy store to ensure functioning of the electromechanical monitoring device upon a failure of an energy mains for the elevator installation.

14. The elevator installation of claim 10, the second braking device being arranged at the elevator cage.

15. The elevator installation of claim 10, the sensor being configured to directly actuate the second braking device.

16. The elevator installation of claim 10, the second braking device comprising a safety brake device.

17. An elevator method, comprising:

pressing a co-running wheel against a guide track of an elevator cage in a readiness setting when the elevator cage is at standstill and spacing the co-running wheel from the guide track of the elevator cage in a normal setting;

detecting a rotation of the co-running wheel in excess of a predetermined rotational angle; and activating a braking device as a result of the detecting.

* * * * *